US006959097B1

(12) United States Patent
Borowsky

(10) Patent No.: US 6,959,097 B1
(45) Date of Patent: Oct. 25, 2005

(54) BEHIND THE EAR HEARING AID WITH FRONT PLATE

(75) Inventor: Hans-Dieter Borowsky, Neuenkirchen (DE)

(73) Assignee: Auric Horsysteme GmbH & Co., Rheine (DE)

( * ) Notice: Subject to any disclaimer, the term of this patent is extended or adjusted under 35 U.S.C. 154(b) by 74 days.

(21) Appl. No.: 10/019,839

(22) PCT Filed: Jul. 4, 2000

(86) PCT No.: PCT/DE00/02256

§ 371 (c)(1),
(2), (4) Date: May 6, 2002

(87) PCT Pub. No.: WO01/05190

PCT Pub. Date: Jan. 18, 2001

(30) Foreign Application Priority Data

Jul. 7, 1999 (DE) ..... 199 30 935
Sep. 1, 1999 (DE) ..... 299 15 308 U

(51) Int. Cl.[7] ..... H04R 25/00
(52) U.S. Cl. ..... 381/322; 381/324; 381/328

(58) Field of Search ..... 381/322–325, 381/327–328, 330, 380, 381; 181/129–130

(56) References Cited

U.S. PATENT DOCUMENTS 5,341,433 A * 8/1994 Meyer et al. ..... 381/324
5,606,621 A * 2/1997 Reiter et al. ..... 381/328
6,430,296 B1 * 8/2002 Olsen ..... 381/322

FOREIGN PATENT DOCUMENTS

DE 81 06 942 U 7/1982
DE 41 21 312 C 5/1992
DE 297 53 569 U 11/1998

* cited by examiner

*Primary Examiner*—Suhan Ni
(74) *Attorney, Agent, or Firm*—Lahive & Cockfield, LLP

(57) ABSTRACT

A behind the ear hearing aid includes a housing having a housing shell configured in a contoured shape. The housing shell houses an electronic circuit and a power storage unit. A multi-function plate designed as a front plate for use in an in-ear hearing aid is adapted to couple to the housing shell to form the behind the ear hearing aid. The multifunction plate includes an access opening for one of the power storage unit and the electronic circuit.

3 Claims, 1 Drawing Sheet

BEHIND THE EAR HEARING AID WITH FRONT PLATE

RELATED APPLICATIONS

This application claims priority to, and the benefit of, PCT International Application Number PCT/DE00/02256 filed on Jul. 4, 2000 claiming priority to German application DE 199 30 935.3 filed Jul. 7, 1999 and German application DE 299 15 308.8, filed Sep. 1, 1999 for all subject matter common to all applications.

BACKGROUND OF THE INVENTION

The invention relates to a hearing aid.

Hearing aids worn behind the ear, hereafter abbreviated as BTE-devices, are commonly constructed of two housing shells in which separating walls form multiple separate chambers within the interior of the housing. The installation process is relatively complex and expensive—both in terms of inserting the power storage unit which must be externally accessible to the user as well as the electronic circuit, microphone, and loudspeaker. Specifically, adapting this type of hearing aid to various technologies, i.e. to different functional characteristics of the electronic circuit, often requires a complicated replacement of the individual components within the hearing aid.

The goal of the invention is to improve a hearing aid so as to render it simple and inexpensive to manufacture.

SUMMARY OF THE INVENTION

The invention proposes, in other words, using a so-called front plate, which is also designated as a "faceplate" and which is well known, for example, in connection with in-ear hearing aids. Such hearing aids were disclosed, for example, in DE 81 06 942 U1 or DE 297 23 569 U1, while patent Abstracts of Japan, E-489 Mar. 13, 1987 Vol. 11. No. 83, Custom Ear Fitting Type Hearing Aid" JP-61-238 198 (A) discloses a hearing aid with such a faceplate which is designed as a combination plate or multifunction plate. This plate not only forms the visible exterior housing surface of the in-ear hearing aid, but additionally all technical devices of the hearing aid are connected to it in such a way that this front plate is simply surrounded by a housing cover which is modeled by an appropriate impression method and adapted to the user's ear.

The use of an analogously designed multifunction front plate considerably simplifies the fabrication of a BTE device since only two modules need to be joined together, i.e. the housing shell and the front plate accommodating the technical components.

Particularly when there are small production runs for such BTE devices, a commercially available mass-produced front plate may be advantageously employed which is normally provided for use in in-ear hearing aids, although with larger dimensions than the dimensions normally required for use in BTE devices. This front plate may easily be mounted on top of the housing shell of the BTE device to be produced, the technical components being accommodated by the housing shell. Any remaining overhanging edges of the front plate, which is usually made of plastic and easily worked, are ground off.

In the event the BTE devices are to be produced in greater production runs, a suitable shape may be achieved in an especially economical manner from the start by mass-producing the front plate such that its contour is adapted to the housing shells. The manufacturer of the front plates simply modifies the injection mold for the plastic so as to match the contour of the front plate to the contour of the housing shell. Insertion of devices into the front plate so modified may thus be accomplished by the manufacturer in precisely the same ways as with previous conventional front plates.

An alternative approach is to reduce the dimensions of the initially larger front plate to the required contour matched to the housing shell immediately before the above-mentioned assembly stage. For example it may be advantageous in terms of inserting the electronic components to be able to pass the front plate in its previous larger dimensions through the automatic assembly machine. In this case, the front plate may be initially fabricated with the larger dimensions, fitted with the electronic components, and subsequently adapted in a cost-effective manner to the contour of the housing shell of a BTE device, for example, by using an automated punch or milling procedure. Excess material may then be removed before the front plate and housing shell are joined while retaining optimal accessibility of the front plate and without risking damage to the housing shell.

The housing shell and front plate may be advantageously joined in a detachable manner so that defective components may easily be replaced or they may be easily adapted to other desired technological properties of the hearing aid by completely replacing the front plate—with the result that in response to increasing miniaturization any manually performed operations on the hearing aid may be avoided and modules may be simply and quickly replaced.

BRIEF DESCRIPTION OF THE DRAWINGS

The following discussion presents an embodiment of the invention in more detail based on the drawings.

DESCRIPTION OF ILLUSTRATED EMBODIMENTS

Figure 1:
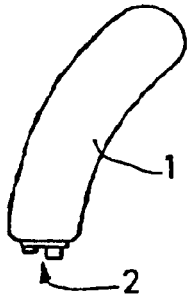
FIGS. 1, 2 and 3 show various views of a housing shell for a behind the ear hearing aid.

Reference 1 in FIG. 1 identifies a housing shell, at the lower end of which housing shell 1 two projections 2 are indicated schematically. These may, for example, be: an on/off switch, a volume control, connector for a sound tube, or similar component.

Figure 2:
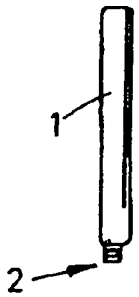

FIG. 2 shows housing shell 1 rotated 90° to show its narrow side.

Figure 3:
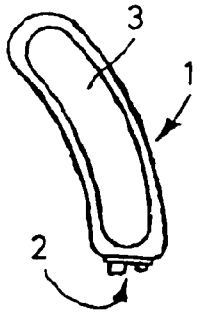

FIG. 3 provides a view of housing shell 1 rotated a further 90° in which the trough-shaped interior 3 of housing shell 1 is visible, which interior serves to accommodate the technological components of the hearing aid.

Figure 4:
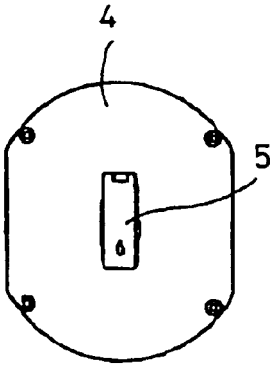
FIG.4 PRIOR ART
FIG. 4 shows a commercially available front plate designed for use with in ear hearing aids.

FIG. 4 shows a front plate 4 which in practice is called a "faceplate" and which, serving as a multifunction plate, has not only a housing or covering function in the hearing aid but also accommodates the technological components of the hearing aid. Visible from the outside is the covering plate of a battery compartment; located on the reverse side of front plate 4 relative to FIG. 4 are the electronic circuit, a loudspeaker, and a microphone if required. As understood within the concept "hearing aid" used in this application, the term microphone may optionally include not only sound-amplifying devices but also sound-generating devices such as tinnitus treatment devices which do not their own built-in microphones.

Figure 5:
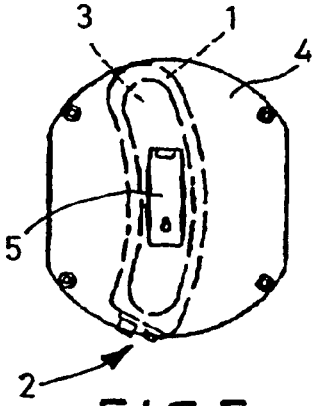
FIGS. 5 and 6 show stages in the fabrication of a behind the hear hearing aid coupled with the face plate for use with in ear hearing aids of FIG. 4, according to the present invention.

FIG. 5 shows how front plate 4 is mounted on housing shell 1, the technological components being accommodated within trough-shaped interior 3. Protruding beyond the exterior contour of housing shell 1 are sections of front plate 4 which are subsequently removed by hand or by machine, e.g., ground away.

Figure 6:
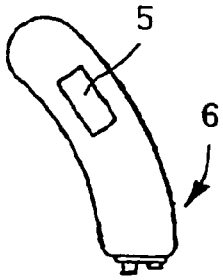

FIG. 6 shows a hearing aid 6 after the excess sections of front plate 4 have been removed. It shows the exterior contour of housing shell 1, front plate 4 preferably being connected to housing shell 1 in a detachable manner, for example by a snap-on feature or possibly even a screw-based connection, such that in any case the removability of the "technical module" is realized in the form of front plate 4 and appropriate repairs or adjustments may be performed easily and quickly.

As a variation on the embodiment shown, a hearing aid 6 according to the invention may also be fabricated by first modifying the front plate to match the contour fitting the housing shell before the assembly stage in which the front plate is joined to housing shell 1. This may be achieved directly by matching the shape to the housing shell at the time the front plate is fabricated—with the result that no subsequent finishing, specifically no removal of excess areas of the front plate, is required, or this adaptation may be achieved by subsequent finishing before the front plate and housing shell are joined.

This type of modification may also include an arrangement of joining means on the front plate: for example, for screwing or clipping together, possibly also the generation of joining surfaces for adhesive bonding, ultrasonic welding, or the like, for joining the front plate to the housing shell.

What is claimed is:

1. A behind the ear hearing aid, comprising a housing having a housing shell configured in a contoured shape, an electronic circuit, a power storage unit, and a multi-function plate designed as an in-ear hearing aid front plate and adapted to couple to the housing shell to form the behind the ear hearing aid, wherein the multifunction plate includes an access opening for one of the power storage unit and the electronic circuit.

2. The hearing aid according to claim 1, wherein the front plate is matched to the contour of the housing shell in standard production.

3. The hearing aid according to claim 1, wherein the housing shell and the front plate are joined in a detachable manner.

* * * * *